United States Patent [19]

Viggiano

[11] Patent Number: 4,712,262

[45] Date of Patent: Dec. 15, 1987

[54] BEDDING RETAINER

[75] Inventor: Frank Viggiano, East Greenbush, N.Y.

[73] Assignee: FMR Corporation, Albany, N.Y.

[21] Appl. No.: 4,640

[22] Filed: Jan. 20, 1987

[51] Int. Cl.[4] ..... A47C 21/02

[52] U.S. Cl. ..... 5/508; 5/498; 24/72.5

[58] Field of Search ..... 5/498, 508, 496, 451; 24/72.5

[56] References Cited

U.S. PATENT DOCUMENTS 267,498 11/1882 Cox ..... 5/498

3,092,848 6/1963 Gronvold ..... 5/498

4,539,723 9/1985 Hillsberry ..... 5/508

OTHER PUBLICATIONS

"Clip Strip", An Ad by all States Waterbed Distrib., 2661 Forrest Lane, Garland, Tex., Feb. 1983.

*Primary Examiner*—Alexander Grosz

*Attorney, Agent, or Firm*—Schmeiser, Morelle & Watts

[57] ABSTRACT

An "L" shaped device having a fabric clamping means near the top of its vertical leg and inserted basewise between a waterbed mattress and its horizontal support platform. A sheet placed over a waterbed mattress may be secured by the clamping means (of a plurality) of such devices and thereby secured to the mattress surface by application of the invention.

2 Claims, 4 Drawing Figures

BEDDING RETAINER

FIELD OF THE INVENTION

The present invention relates generally to a means for retaining sheets, blankets and similar bed clothes in a relatively fixed position on a waterbed mattress and, more specifically, to an apparatus which will secure the waterbed sheet, primarily the lower, snuggly about the periphery of the waterbed mattress.

BACKGROUND OF THE INVENTION

It has long been the object of inventors, who deal with the art form recited in the aforementioned field of the invention, to provide various and sundry means, as well as apparata, to ensure that bed clothes, principally sheets, are secured to a mattress.

That such retention of bed clothes is a long-felt need is evidenced by the patent issued to Cox, U.S. Pat. No. 267,498, on Nov. 14, 1882. Cox devised a bed clothes fastener which comprised an "L" shaped apparatus, the lower or horizontal leg of which slipped between the rigid mattress and its platform support. The vertical leg of the "L" further comprised a clip-like bed sheet retention means. Because the conventional mattress, or the box spring, is rigid and essentially inflexible at its periphery, the Cox clamp, or bed sheet clasping mechanism, was well suited for the use to which it was placed. Today, with the advent of the waterbed mattress, which is essentially a liquid-filled bladder, the Cox apparatus finds limited application. Its most significant drawback is the relative inflexibility of the "L" shaped member. This is due in no small part to the fact that the vertical member of the Cox "L" must be rigidly affixed to the horizontal leg. This inflexibility was inconsequential during the era in which Cox invented the apparatus simply because there was no transverse pressure exerted against the vertical member by the rigid mattress or box spring.

In 1963, Gronvold, in U.S. Pat. No. 3,092,848, sought to retain a bed sheet of smaller than conventional size on a conventionally sized mattress. It was Gronvold's contention that a good deal of the (then) present-day bed sheet was comprised of excess material, the function of which was to be tucked under the mattress, thereby retaining the sheet snuggly on the mattress. Gronvold reasoned, while still dealing with the relatively rigid mattress, that all that should be required was an apparatus which would clasp the hem or the margin of the bed sheet and urge the secured points towards the bottom center of the mattress. Thus, he contrived a spider-like apparatus consisting of an even number of strips of elastomeric material radiating outwardly from a common center. At the ends of these radiating members, there were affixed bed sheet clamping clips which were themselves comprised of an elastic tab, or detent, which had attached thereto a spring clip. The latter element, in reality, comprised the familiar garter belt hosiery clip such as was found on garter belts, corsets, etc. The entire apparatus was placed beneath the bed mattress, or box spring, with its radial center positioned at the center of the mattress or box spring. The clip members were then brought up and around the bed ensemble, preferably at the corners with each corner accommodating a clip on either side.

The use of ancillary apparata to retain the flat or planar sheets was forgotten with the advent of the "fitted sheet". The fitted sheet represented a reasonable solution to the problem of securing the sheet to a conventional, rigid mattress. However, with the later development of the liquid filled bladder, commonly referred to as water mattress or waterbed, the problem of slipping and non-retainable bed clothes reappeared. It is well recognized by those producing and selling accessories for waterbeds that the fitted sheet is usable with the water mattress only for the purposes of making the bed or placing the bed clothes on display. The moment one attempts to recline on the sheet-covered mattress, the force is transmitted hydraulically and uniformly throughout the bladder resulting in the ballooning corners of the water mattress quite literally "sheding" themselves of the confining, unyielding sheet, irrespective of whether the corners are fitted.

It appeared to the inventor that, where the prior art sought a means to clamp the bed sheet, the problem with the present day water mattress has shifted to a need for some means to hold the clamp means stationary.

It is therefore the primary object of this invention to devise a means for holding planar fabrics such as sheets and blankets in a relatively stationary position on the waterbed mattress.

The invention therefore consists in the novel parts, construction, combination and principles herein shown and described.

SUMMARY OF THE INVENTION

The inventor has discovered that the principal object of this invention may be realized by forming an "L" shaped semi-rigid device which bears merely a resemblance to a common metal, plastic or wooden book end. The base leg is formed so as to fit unobtrusively beneath a waterbed mattress, that is, between the mattress and its horizontal supporting platform. At the top of the device's upper leg, facing outwardly and away from the center of the mattress (opposite the direction of the base leg), is an integral detent element. The detent element may be of any geometrical shape which is readily produced in integral form. The preferred embodiment utilizes a projection of semi-cylindrical shape with the major axis of the cylinder aligned parallel to the top margin of the vertical leg (or the horizontal plane of the mattress). At each end of the cylindrical projection is a detent.

The second element of the device, which may be attached by suitable means to the vertical leg, is an elastomeric band which is made to fit snuggly over the detents located at each end of the cylindrical projection.

In operation, the base leg of the device, once inserted under the waterbed mattress, ensures that the bladder-contained hydraulic medium will be held in close registry therewith and against the vertical leg. Because the force in an hydraulic medium is transmitted equally in all directions, the vertical leg should preferably be of a lesser cross sectional area than the lower. This will ensure that a greater force is always placed on the lower leg, thus retaining the device in a stationary position. The transverse hydraulic force will urge the vertical legs (of all devices) outward from the mattress center. Thus, the detents or projections are forced outward from the mattress center with equal force and depressed below their rest center, irrespective of the weight or position of the body reclining on the mattress. This is an important feature of the invention-the same (equal)

force is placed at every point of constraint on the clasped sheet.

After the several devices are installed about the periphery of the mattress, preferably arranged in a one-to-one correspondence and opposing each other across the center of the mattress, a sheet is spread over the mattress. Connection of the sheet hem is made at the detent or projection of each device by passing the sheet over the projection and immediately clamping it thereto with an elastomeric band. Unlike the fitted sheet, it is not necessary to connect opposing sides first; but rather, the person making the bed may merely walk around its periphery making the aforementioned connections.

An alternative embodiment conceives of the use of a more rigid and non-elastic clamp to fit over the projection or detent. Such a device was disclosed by Larimer in U.S. Pat. No. 642,236, issued Jan. 30, 1900. The inventor has deliberately avoided this type of art in his preferred embodiment because of the necessity of producing special fitted clasps or clamp elements. Instead, as those familiar with the art will recognize, he has chosen a simple, inexpensive and readily available clamping means to work in combination with a new flexible element that will remain stationary when acted upon by a confined hydraulic medium.

As should be understood by those reading the foregoing general description, and the following detailed description as well, the preferred embodiment is both exemplary and explanatory of the invention; but are not meant to be restrictive thereof. The invention is particularly adaptable to production by present-day plastic molding techniques; although, it is also conceivable that a manufacturer having a large inventory of flexible book ends of the metallic or plastic types may readily adapt them, through a minimal materials removal and forming process, to devices of the instant invention.

The accompanying drawings, referred to herein and constituting a part hereof illustrate the aforementioned preferred embodiment, as well as the suggested alternative. Together with the description, these serve to disclose the operating principles of the invention.

DESCRIPTION OF THE PREFERRED EMBODIMENT

Figure 1:
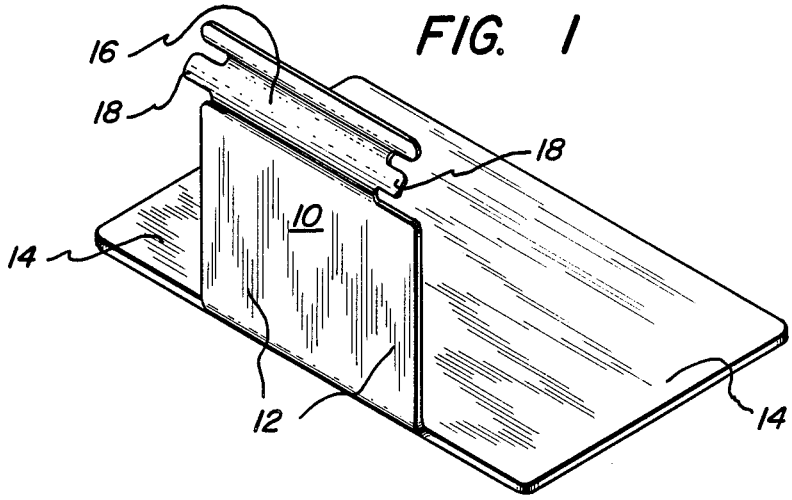
FIG. 1 is an isometric illustration of the "L" shaped element.

Referring more particularly now to FIG. 1, there is illustrated the preferred embodiment of the invention 10 comprised of a suitable material such as high density polyethylene, thermo-set plastic, or light-weight sheet metal. The wider base leg of the "L" structure is depicted as element 14 and is integral with vertical leg 12. Base 14 and vertical leg 12 meet at a nominal right angle. Near the top margin of the vertical leg projects cylindrically shaped element 18. The cylindrical projection 18 is, in cross section, convex to the herein depicted surface of vertical leg 12. At each end of cylindrical projection 16 are lobes 18.

Figure 2:
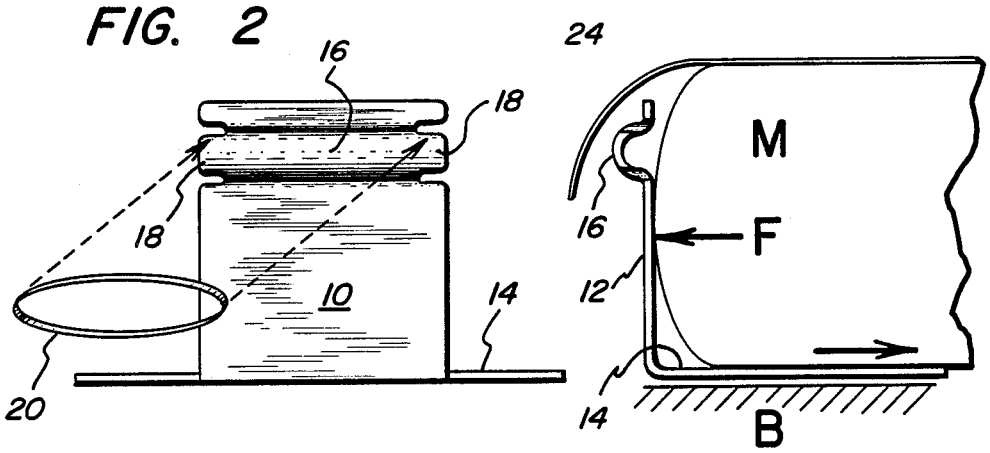
FIG. 2 is an orthographic front and side view of the invention with cylindrical projection.

The orthographic portrayal of FIG. 1 is effected in FIG. 2 so that lobes 18 may be more clearly defined. Elastomeric band 20 is also illustrated, as is the manner in which it is intended to fit over cylindrical projection 16 by snapping or fitting around lobes 18. As the invention is principally used, base 14 is slipped between mattress M and its horizontal base support B in the manner shown in the right hand illustration of FIG. 2. After the invention is firmly emplaced, sheet 24 may be brought down over projection 16. Thereafter, the user simply stretches band 20 over the sheet so that it engages lobes 18 and constricts to fit thereover. A plurality of the devices of this invention are used along the periphery of the water mattress, generally with one device being placed directly opposite another, across the center of the mattress.

Once a suitable number of the devices are installed, and the sheet 24 attached thereto, one can comprehend intuitively that the force exerted by the liquid-filled bladder M on base 14 will sufficiently load the invention 10 so that it will remain immobile in the position in which it was inserted relative to M and support B. Transverse force F will be transmitted through vertical leg 12, thus insuring that sheet 24 will be urged in the general direction depicted by arrow F. Since the hydraulic force is being exerted in all directions, it is also intuitive that all devices, which have been inserted, will be subjected to the forces depicted on the individual unit of FIG. 2; and, will accomplish the sheet stretching characteristics heretofore described.

Figure 3:
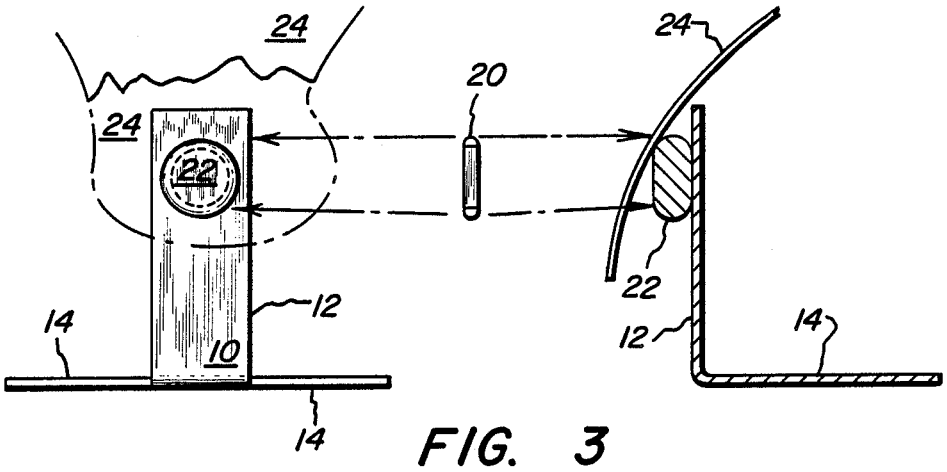
FIG. 3 is an orthographic view of the invention with simple detent projection.

FIG. 3 is an alternative embodiment depicting an essentially circular shaped detent 22 which may be either molded with device 10 or affixed in the illustrated position subsequent to the production of 10, and held thereon by suitable means. The cross sectional view given at the right hand side of FIG. 3 illustrates the latter manner of affixing detent 22 to vertical leg 12. As those versed in the art of plastics production will realize, it is feasible to incorporate the art depicted in both FIGS. 2 and 3 in a singular molding process, acquiring the basic "L" shape as well as a smooth protrusion to act as either the cylindrical projections 16 or (projection) detent 22.

Figure 4:
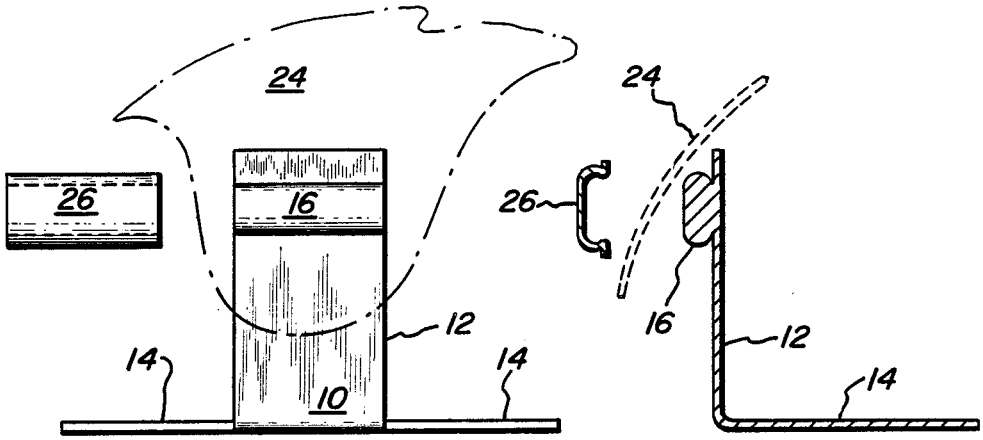
FIG. 4 is an orthographic view of the invention in an alternative embodiment.

FIG. 4 illustrates an alternate embodiment of the present invention combining the clamping method of Larimer (U.S. Pat. No. 642,236) which, although clearly feasible lacks the projection and use simplicity of the instant invention. In the FIG. 4 device, cylindrical projection 16 is produced integral with vertical leg 12. A cylindrical, "C" shaped clamp 26, comprised of suitable flexible materials such as high density polythene, is snapped over projection 16, capturing sheet 24 therebetween.

This invention, in its broader aspects, is not limited to the specific embodiments which have been shown here and described. Departures, within the scope of accompanying claims, may be made from the disclosed art without departing from the principles herein.

What is claimed is:

1. A planar fabric retention apparatus for securing said fabric to the top surface of a liquid filled bladder comprising:

an "L" shaped semi-rigid bracket which has a detent projecting from the upper margin of the vertical leg in a direction essentially opposite the lower base leg; and an elastic band to resiliently fit about said detent whereby a planar fabric passed over said detent may be captured thereon by affixing said band thereabout.

2. A device for securing a planar fabric to a waterbed mattress comprising:

a flexible "L" shaped bracket comprised of a vertical leg of essentially rectangular shape and a horizontal base leg of essentially rectangular shape and further comprising fabric securing means integral with said vertical leg said securing means further comprising an integral projection from said vertical leg in a direction opposite the horizontal base leg element, and an elastomeric band for securing said planar fabric on said projection by constriction thereon.

* * * * *